United States Patent [19]

Sneden

[11] Patent Number: 4,566,698

[45] Date of Patent: Jan. 28, 1986

[54] CHARACTER IDENTITY GAME

[76] Inventor: Marcia A. Sneden, 27 Colony Rd., Lexington, Mass. 02173

[21] Appl. No.: 694,124

[22] Filed: Jan. 23, 1985

[51] Int. Cl.[4] ..... A63F 3/00; A63F 9/18

[52] U.S. Cl. ..... 273/249; 273/288

[58] Field of Search ..... 273/243, 248, 249, 287, 273/289; 434/348, 347, 327

[56] References Cited

U.S. PATENT DOCUMENTS

| | | | |
|---|---|---|---|
| 3,104,106 | 9/1963 | Kenney et al. | 273/249 |
| 3,939,578 | 2/1976 | Coffey | 273/243 X |
| 4,105,202 | 8/1978 | McLaren et al. | 273/309 |
| 4,272,080 | 6/1981 | Breslin | 273/249 |
| 4,315,627 | 2/1983 | Schleget et al. | 273/249 |
| 4,323,249 | 4/1982 | Brady | 273/249 |
| 4,416,454 | 11/1983 | Delamontagne | 273/243 |
| 4,445,867 | 5/1984 | Berg et al. | 434/404 |

OTHER PUBLICATIONS

"Trivial Pursuit" ® Master Game Rules of Play.

*Primary Examiner*—Richard C. Pinkham
*Assistant Examiner*—Scott L. Brown
*Attorney, Agent, or Firm*—John P. McGonagle

[57] ABSTRACT

A competitive character identification game comprising a game board with start and finish blocks, and intermediate play blocks, along with resumes and cards containing biographical clues to as well as the identity of different real and fictional characters. The resumes are stored in a clue box which contains clue windows for presenting the various clues contained on individual resumes. As the players move about the game board using a chance device to determine the number of spaces, clue windows are opened during each turn, revealing additional information about a particular character. During a later stage of the game, the cards are used, each one containing several clues about a particular character. During the game, the players compete to progress from the starting block to an end game block on the game board by identifying characters. Playing tokens are used to identify a player's location on the board in the course of playing the game. Chips are issued to individual players at various points in the game. The chips allow a player to obtain additional information about a particular character. Scoring pins are used to track the number of characters correctly identified by a player.

6 Claims, 11 Drawing Figures

20

| | |
|---|---|
| I was born into a prosperous Family (24) | I appointed the first Jewish Cabinet Member |
| I was a Harvard Graduate | My daughter married a future Speaker of the House |
| ...A War Hero | My niece married a future U.S. President. |
| ...A Published Historian | My son was a WW II General |
| ...and a U.S. President | I lived at Sagamore Hill |
| I was the youngest man ever to hold that office. | (26) I said,"I am as strong as a bull moose." |
| I was shot during a campaign trip... | (25) I wrote The Winning of the West. |
| ...but survived. | I appointed Oliver Wendell Holmes to the Supreme Court. |
| Douglas MacArthur was my Aide-De-Camp. | (27) I was the first U.S. Nobel Laureate, winning the peace prize |
| My V.P. was Charles Warren Fairbanks | (23) THEODORE ROOSEVELT |

FIG 2b

20

24

I was born in January, 1854, but some dispute the date.

I was educated at Public School and at Cambridge.

I wrote "Upon the Polyphonic Motets of Lassus"

...and a Handbook on Bee Culture.

I frequently worked with Gregson and Le Strade.

Under the name Sigerson, I explored Tibet.

My interests included Chemistry,

...Boxing,

...and sensational literature.

I have been portrayed by Raymond Massey,

...Sir John Gielgud,

...and John Barrymore.

I had a less famous brother about whom a movie was made.

My housekeeper was Mrs. Hudson

I lived at 221B Baker Street

26

My chief adversary was Professor Moriarty

25

I never married, but my long time companion did.

I was thought to have died at the Reichenbach Fall, but I survived

27

My "Boswell" has been portrayed by Nigel Bruce.

23

SHERLOCK HOLMES

FIG 2c

CHARACTER IDENTITY GAME

BACKGROUND OF THE INVENTION

This invention relates to a game and more particularly to a game played on a board with movable pieces whose progress in the game is determined partly by chance and partly by skill.

This game is an adult level game. Up to six players, more if in teams, may conveniently play the game, deriving entertainment and knowledge therefrom. According to the game, a player progresses from start to finish on paths delineated on the surface of the game board, initially about the board's periphery and ending at the center of the board.

The prior art included various patents relating to identifying characters in a game. More particularly, U.S. Pat. No. 4,315,627 to Schleget, et al, discloses a game board apparatus having a board with playing pieces, and a series of cards each relating to a public figure in various categories of activity. In the Schleget game, one player assumes the identity of a character which in turn is determined by a character card. The other players then question the first player attempting to determine his identity. Successful and unsuccessful guesses determine each player's general progression about the game board.

The present invention is similar in that a game board and playing pieces are used. However, character identification is by clues and clues are obtained as a function of various chance and tactical/strategic devices and methods. No one player portrays a character. The present invention uses multiple paths where the Schleget game uses only one. The present invention also contains multiple levels of clues and guesses, where the Schleget game uses only one, although different categories of characters may be used. The present invention eliminates much of the subjectivity inherent in the Schleget game and also introduces a greater element of chance.

SUMMARY OF THE INVENTION

By the present invention, a game board with start and finish blocks, and intermediate play blocks, is provided along with resumes and cards containing biographical clues to as well as the identity of different real and fictional characters. The resumes are stored in a clue box which contains clue windows for presenting the various clues contained on individual resumes. As the players move about the game board using a chance device to determine the number of spaces, clue windows are opened during each turn, revealing additional information about a particular character. During a later stage of the game, the cards are used, each one containing several clues about a particular character. During the game, the players compete to progress from the starting block to an end game block on the game board by identifying characters. Playing tokens are used to identify a player's location on the board in the course of playing the game. Chips are issued to individual players at various points in the game. The chips allow a player to obtain additional information about a particular character. Scoring pins are used to track the number of characters correctly identified by a player.

The differences between the Schleget game and the present invention become even more apparent. The present invention, to a greater degree than the Schleget game, is a learning, as well as an entertainment game. In Schleget, the questions and answers are limited by the shared knowledge of the players. It is conceivable that the person answering or questioning does not know anything about the character. With the present invention, the clues may provide the players with information they did not previously have, and/or with helpful information they would not have thought to ask for. The game is so structured that it almost guarantees that someone can finally identify the character. An important distinction between the two games lies in the availability of information about a character. In Schleget, it appears that all players automatically learn of all information developed. In the present invention, some players may use chips to obtain more information than others. This adds an important tactical/strategic element to the present invention not present in Schleget, i.e., the chips. Present invention players must decide when to use this source of information. Another important distinction lies in the fact that the present invention can be played by one person, i.e., playing against the clue box, while Schleget cannot.

For a better understanding of the invention, its advantages, and objectives obtained by its use, reference should be had to the drawings, which form a further part hereof, and to the accompanying descriptive matter, in which there is illustrated and described a preferred embodiment of the invention.

DETAILED DESCRIPTION OF THE INVENTION

Figure 1:
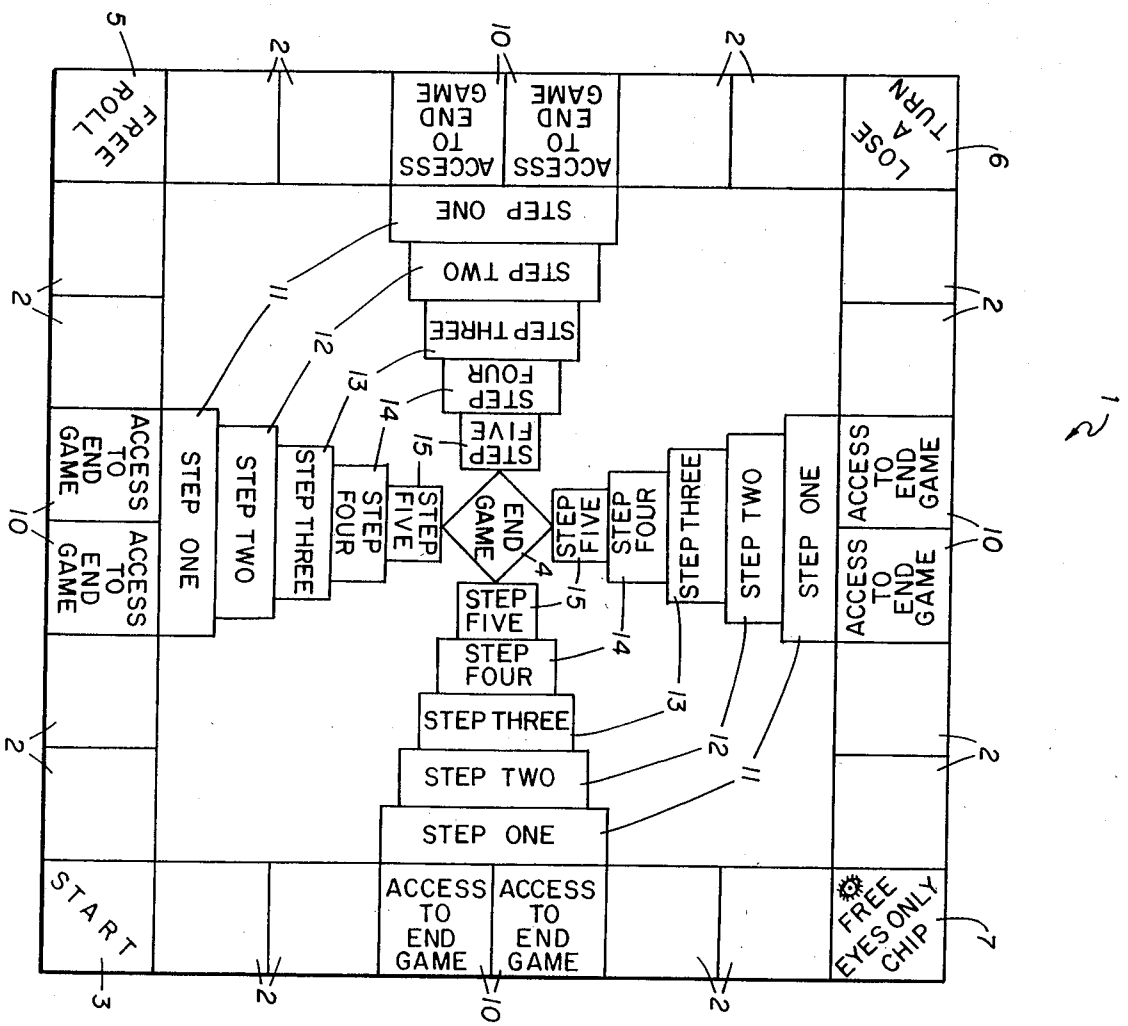
FIG. 1 is a top plan view of a game board according to the present invention.

Referring more particularly to the drawings in detail, wherein like numerals indicate like elements, reference numeral 1 refers generally to a four-sided game board comprising the board apparatus of the invention. FIG. 1 shows in top plan view a game board 1 having a substantially square configuration. The game board 1 includes a plurality of marked blocks and spaces forming various paths from the Starting block 3, extending about the periphery of the game board 1, and branching off and finishing at the End Game block 4 in the center of the game board 1.

In this embodiment of the game, there are twenty-eight blocks forming a main track about the periphery of the board 1. At selected points about this main track, there are, in addition to the Starting block 3, Access to End Game blocks 10, a Free Roll block 5, a Lose A Turn block 6, and a Free Eyes Only Chip block 7. The Starting block 3 is at one corner of the board 1. Moving clock-wise about the main track, the next corner contains the Free Roll block 5; the next corner after that contains the Lose A Turn block 6; and the corner after that contains the Free Eyes Only Chip block 7. The third and fourth blocks in either direction of a corner block are Access To End Game blocks 10. The remaining blocks 2 are undesignated play blocks, not otherwise marked, and may contain any convenient markings, drawings, pictures, or other graphics.

Between the End Game block 4 in the center of the board 1 and each pair of Access To End Game blocks 10 are five, generally rectangular Step blocks forming separate paths between the End Game block 4 and each pair of Access To End Game blocks 10. The Step block nearest each pair of Access To End Game blocks 10 are termed Step One blocks 11. The Step blocks next to the Step One blocks 11 toward the End Game block 4 are termed Step Two blocks 12. The Step blocks next to the Step Two blocks 12 toward the End Game block 4 are termed Step Three blocks 13. The Step blocks next to the Step Three blocks 13 toward the End Game block 4 are termed Step Four blocks 14. The Step blocks next to the Step Four blocks 14 adjacent to the End Game block 4 are termed Step Five blocks 15.

Figure 2A:
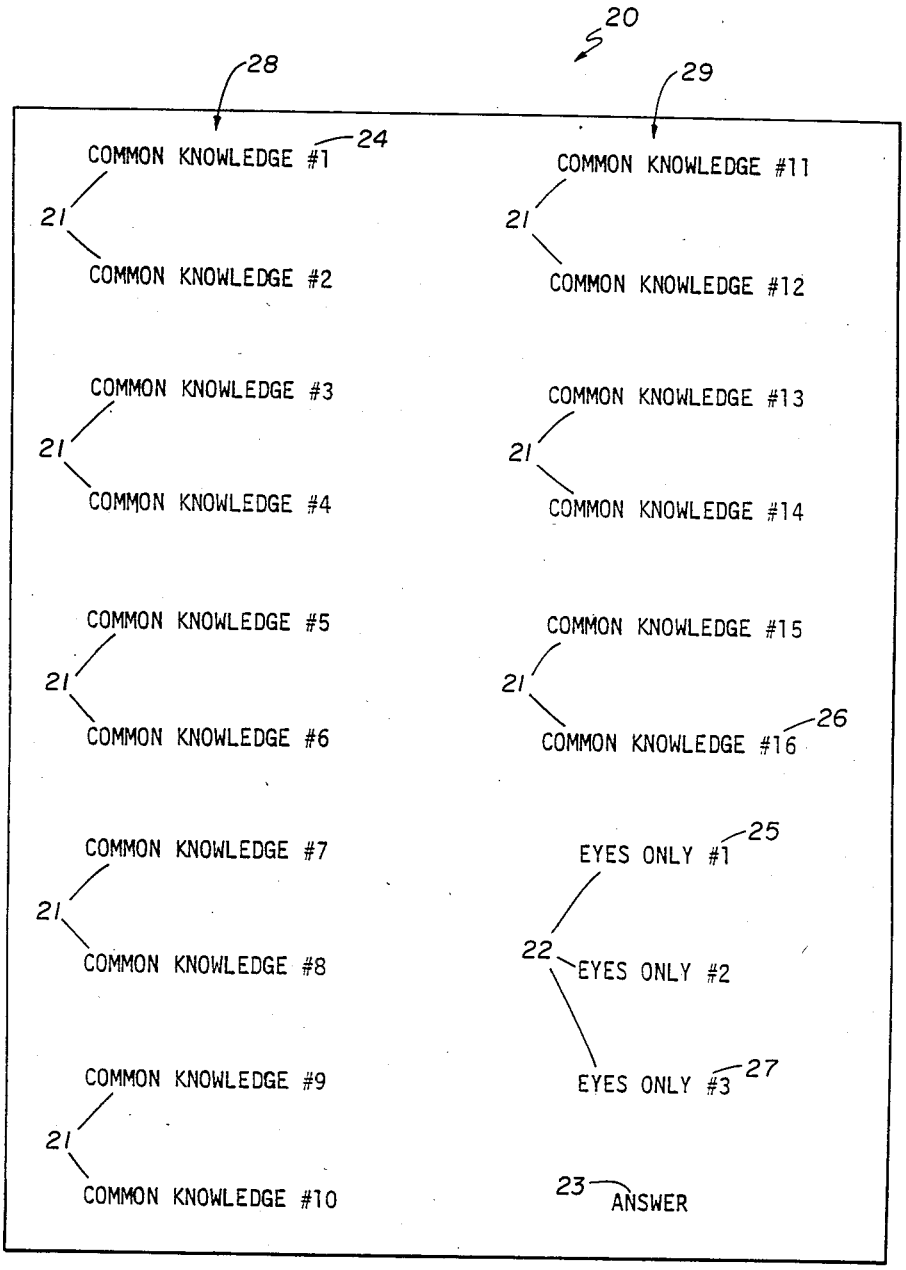
FIG. 2 contains top plan views of the faces of resumes, showing the format of the entries contained thereon, and typical examples of real and fictional character resumes.

FIG. 2 contains top plan views of the character resumes 20 used in this embodiment of the invention. The resume 20 format is shown in FIG. *2a*. Each resume 20 has twenty entries on a side pertaining to a specific character. The first sixteen entries are Common Knowledge clues 21; the next three are Eyes Only clues 22; and the last entry is the Answer 23 identifying the character. The entries are arranged in two vertical rows 28 and 29 of ten entries each. The Common Knowledge clues 21 and the Eyes Only clues 22 are arranged so that ten of the Common Knowledge clues 21 fill the first vertical row 28. The six remaining Common Knowledge clues 21 are positioned in the first six entries of the second vertical row 29. The remaining four entries in the second vertical row 29 are filled first with the Eyes Only clues 22, and then the Answer 23. The Common Knowledge clues 21 and the Eyes Only clues 22 progress from the obscure (first Common Knowledge clue 24 and first Eyes Only clue 25) to the more obvious sixteenth Common Knowledge clue 26 and third Eyes Only clue 27). In this embodiment of the invention, each resume 20 is printed on a letter-size sheet of stiff paper. There are approximately four hundred resumes 20. FIG. *2b* contains a sample resume 20 of a real character, and FIG. *2c* shows a sample resume 20 of a fictional character.

Figure 3:
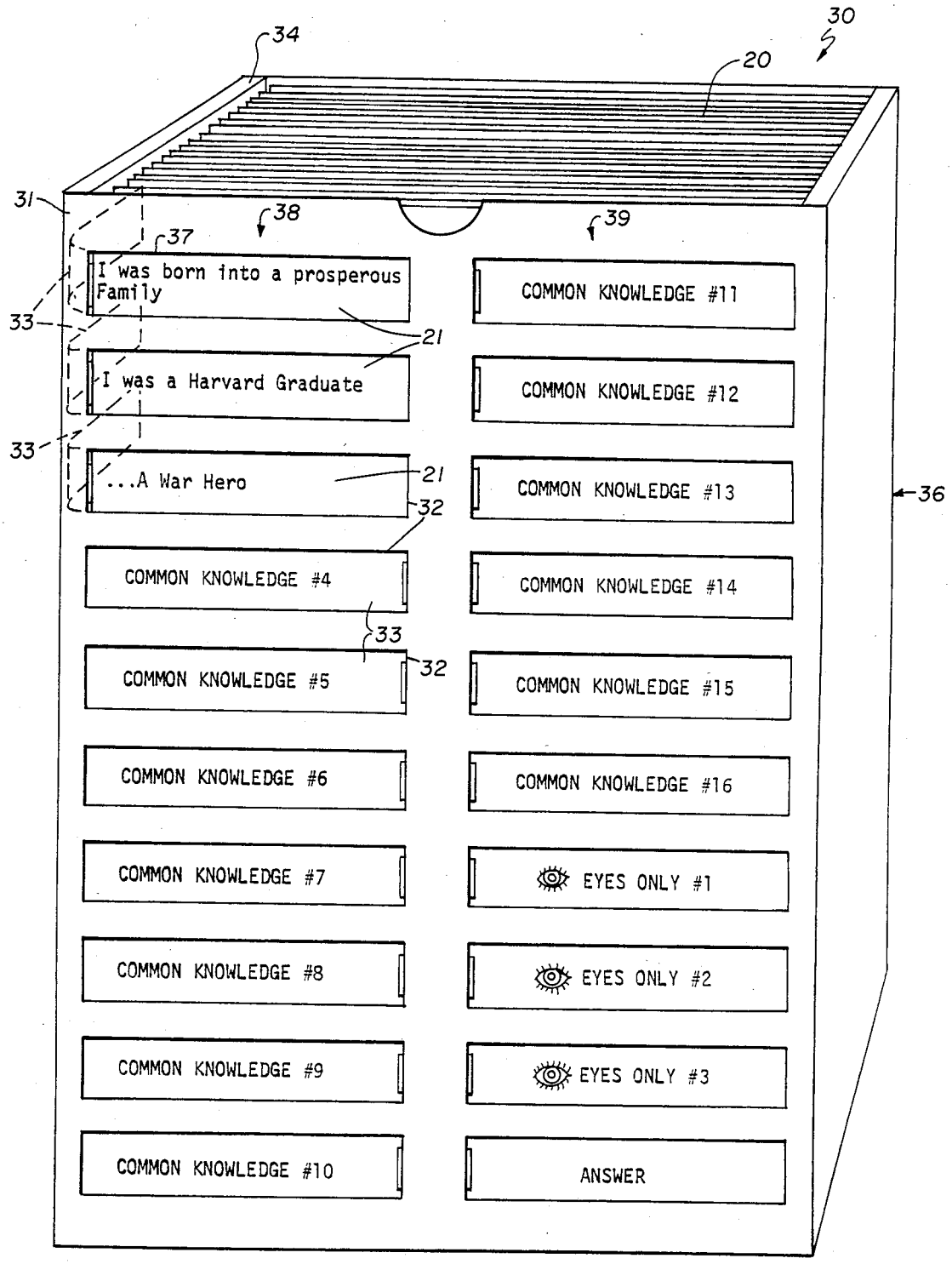
FIG. 3 is a perspective view of a clue box.

The resumes 20 are stored in a container, termed a clue box 30. FIG. 3 contains a perspective view of a clue box 30. The clue box 30 has a generally rectangular shape with a depth sufficient to hold four hundred resumes 20. The longitudinal axis of the clue box 30 is positioned vertically. The clue box 30 is open at the top 34 so that the resumes 20, either singularly or as a whole, may be removed or inserted. The face 31 of the clue box 30 contains two vertical rows 38 and 39 of ten windows 32 each. The windows 32 have a generally rectangular shape, with the longitudinal axis positioned horizontally. The wondows 32 correspond to the entries 21, 22, and 23 on the resumes 20. In this embodiment of the invention, the windows 32 are opened and shut by hinged panels 33, one for each window 32. Other methods which could be used in place of hinged panels 33 include sliding panels, top-hinged panels, and bottom-hinged panels. The resumes 20 inside the clue box 30 and the windows 32 on the face 31 of the clue box 30 are so arranged that, when a window 32 is opened, a Common Knowledge Clue 21, Eyes Only Clue 22, or Answer 23 is revealed on the resume 20 immediately inside and against the face 31 of the clue box 30. Each window 32 is labeled, either on its panel 33 or to one side of the window 32, with a category, i.e., Common Knowledge Clue, Eyes Only Clue, or Answer.

Figure 4A:
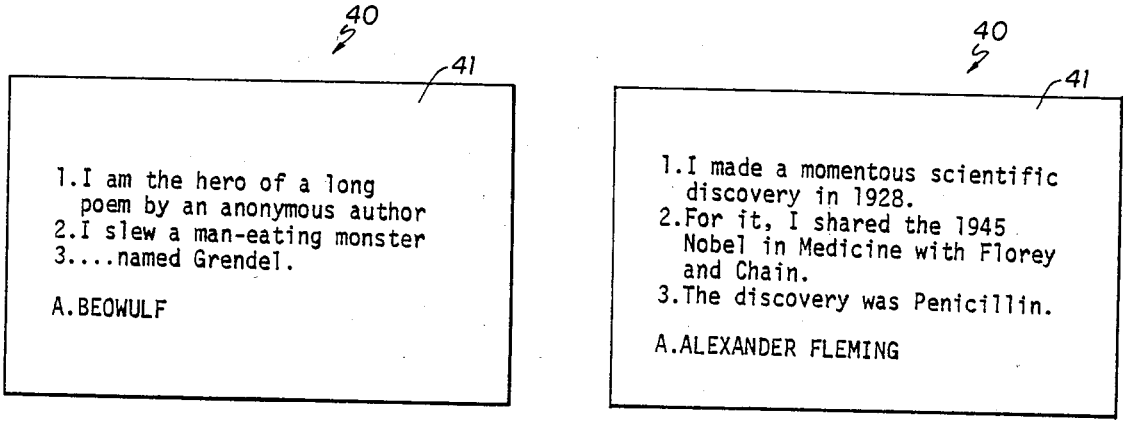
FIG. 4 contains top plan views of both sides of cards which are typical of those employed in the game.
Figure 4B:
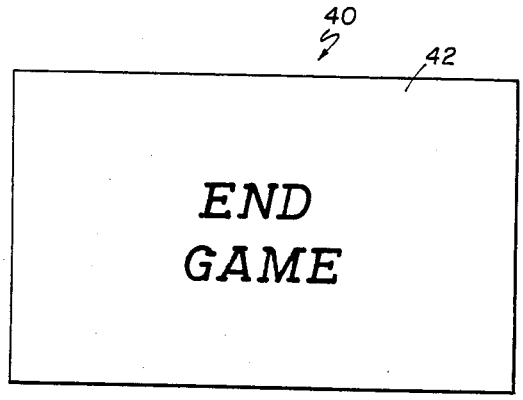

FIG. 4 describes the cards, termed End Game cards 40, used in this embodiment of the game. One side 41 of the End Game card 40 (see FIG. *4a*) contains three clues (obscure to less obscure) about a particular character as well as the name of the character. The reverse side 42 (see FIG. *4b*) contains an identifier that the cards 40 are End Game cards. There are approximately two hundred cards 40 used in this embodiment of the game. Each card 40 has a generally rectangular shape with approximate dimensions of three and one-half inches by two and one-half inches.

Figure 5:
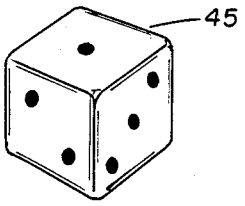
FIG. 5 is a perspective view of a standard die.

FIG. 5 discloses the standard die 45 normally used to determine which player will commence play and the number of blocks a player may advance around the board 1. In lieu of the die 45, a spinner dial and card or any other convenient means for making the foregoing selections can be used whereby one player may receive a higher number than the other players.

Figure 6:
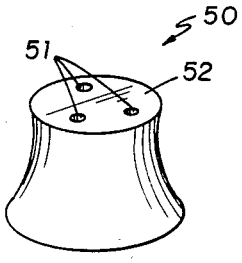
FIG. 6 is a perspective view of typical tokens utilized by the various players in the game.

Each player has a token 50 to identify his position on the board 1. The token may be any shape or size but must have the ability to hold three scoring pins 55 described below. FIG. 6 discloses a typical token 50 with holes 51 in the top 52 to hold scoring pins 55. Conveniently, the tokens 50 may be of different colors to distinguish one from another. Numbers, modified shapes, symbols, or other means may also be used, alone or in combination, to distinguish the various tokens 50.

Figure 7:
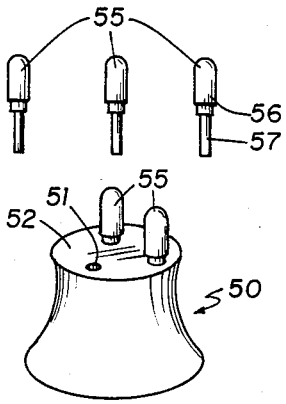
FIG. 7 is a perspective view of scoring pins alone and inserted in the token described in FIG. 6.

FIG. 7 is a perspective view of the scoring pins 55 used in this embodiment of the game. The scoring pins 55, which may be made of any material, consist generally of a member 56 thick enough to grasp by a players fingers. This member 56 is either tapered or is attached to a thin, rod-like piece 57 by means of which the pin 55 may be attached to the token 50. The scoring pins 55 are disclosed alone and also inserted in the token 50 described in FIG. 6. This embodiment of the game uses approximately twenty-five scoring pins 55.

Figure 8:
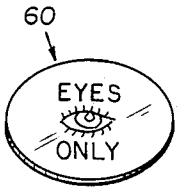
FIG. 8 is a perspective view of a chip which is typical of those employed in the game.

This invention also uses up to seventy-five chips 60 (see FIG. 8). The chips 60 are generally flat and disk shaped. They may be made of plastic or some other convenient material. Each chip 60 is approximately the size of a dime and is printed with an Eyes Only graphic, which should be similar to that used on the game board 1 and the clue box 30.

OPERATION

The object of the game is for one of a plurality of players, each represented by a token 50 and beginning at the Start block 3, to reach the End Game block 4 at the center of the game board 1, by correctly identifying the real or fictional characters whose biographical information appears on resumes 20 and End Game cards 40. The clues to each character's identity fall into two categories, i.e., Common Knowledge clues 21 and Eyes Only clues 22. The clues are contained on resumes 20 and End Game cards 40 and begin with obscure data and progress to more obvious information.

At the beginning of the game, all of the resumes 20 are placed in the clue box 30. The clue box windows 32 are all closed. Each player is given a token 50 and three Eyes Only chips 60. The chips 60 are used by a player to buy Eyes Only clues 22 when it is his turn. Additional chips 60 may be obtained by landing on the game board's Free Eyes Only Chip block 7 or by correctly identifying a character on a resume 20. The players' tokens 50 are all placed on the Start block 3. The die 45 is thrown by each player and the one receiving the highest number goes first. The remaining order of players may be in accordance with their numbers thrown on the die 45 or clock-wise from the first player.

The first player moves from the Start block 3 clockwise around the board 1 a number of blocks equal to the number thrown on the die 45. At this point in the game, all players are confined to the main track blocks about the periphery of the board 1. Landing on any block except the Lose A Turn block 6 entitles that player to open a clue box window 32. The window 32 opened must be a Common Knowledge window and must be opened in sequence starting with Common Knowledge #1 37. None can be skipped. All players may look at the information revealed on the resume 20 entry appearing in the opened window 32. Once a Common Knowledge window is opened, it stays open until the resume Answer 23 is correctly guessed. Players may guess only when it is their turn.

The player whose turn it is now has three options: guess the character's identity; use one or more of his Eyes Only chips 60 to buy Eyes Only clues 22, one clue per chip; or pass the die 45 to the player whose turn is next without guessing. If the player chooses to guess, he must either announce his guess to the other players or write it down where the other players cannot see it. He alone then looks at the Answer 23 under the last window 32 and announces whether he is right or wrong. The player may choose to write his guess if he feels that the other players would be helped by a known wrong guess. A written guess must be revealed to the other players only if the guesser claims to have answered correctly. If the player admits he guessed wrong, he need not reveal his written guess. If the player's guess is wrong, he does not receive another turn until this particular character's identity is correctly guessed or a new character resume 20 is put into play. His token 50 is left on the block on which he was when he made the incorrect guess. If the guess is correct, the player is given a scoring pin 55, which he inserts or attaches to his token 50, and an Eyes Only chip 60. The player retains control of the die 45, the windows 32 of the clue box 30 are closed, and the old resume 20 is removed and positioned at the back of the resume pack. A new resume 20 is now positioned against the inside of the clue box face 31.

If the player had elected to buy one or more Eyes Only clues 22, he would be required to start with the first Eyes Only Window (#1), revealing the first Eyes Only clue 25, and proceed in sequence to the third 27. The Eyes Only clues 22 may only be seen by the player or players buying them. The Eyes Only windows 32 are closed after the player entitled to do so has looked at them. The player may then guess the identity of the character with the same consequences as described above, or he could pass the die 45 to the next player.

If a player lands on the Free Roll block 5, he obtains a free turn. By landing on the Lose A Turn block 6, he loses a turn and must immediately pass the die 45. As stated above, landing on the Free Eyes Only Chip block 7 entitles the player to an additional chip 60. At this point in the game, the Access To End Game blocks 10 have no special meaning and merely comprise play blocks in the main track.

Play continues until the character's identity is established or until all players give up on the character. If one player is left in a given character round, he may look at all the Common Knowledge clues 21 free, but may look at the Eyes Only clues 22 only if he buys them. Once a character is correctly identified, or all of the players give up, the clue box windows 32 are all closed. The used resume 20 is moved to the back 36 of the clue box 30. A new resume 20 will then be positioned behind the clue box widows 32.

When a player has obtained three scoring pins 55 by correctly identifying three characters over the course of the game, he proceeds to End Game. After identifying the third character, the player has one roll of the die 45 to reach the nearest Step One block 11 (always moving in a clock-wise direction). A Step One block 11 must be approached from an Access To End Game block 10 and not diagonally from another block 2. If the roll of the die 45 is insufficient to take the player to a Step One block 11, the player must pass the die 45 and wait until his next turn before rolling the die 45 again. If the roll exceeds the number needed, he must still stop on the Step One block 11. Another player draws an End Game card 40 and reads to him the first clue on the End Game card 40. The End Game player may guess the character's identity after the first clue, or ask for the second clue and then guess, or even ask for the third clue and then guess. If the End Game player guesses wrong at any point, he must wait until his next turn to continue play. If he guesses correctly after the first clue, he advances three steps. If he guesses correctly after the second clue, he advances two steps. If he guesses correctly after the third clue, he advances one step. The End Game player retains his turn until he either guesses wrong or cannot identify an End Game character after the third clue on the End Game card 40. He must then wait for his next turn. The first player to reach End Game block 4 wins the game.

It is understood that the above-described embodiment is merely illustrative of the application. The basic teachings of the present invention have been described above. Many extensions and variations will be obvious to one having ordinary skill in the art. Many, if not all of the physical aspects of the game are flexible, i.e., number of blocks, dimensions, colors, etc. The number of resumes 20 and End Game cards 40 may be increased and even sub-divided into topical categories. Other embodiments may be readily devised by those skilled in the art which will embody the principles of the invention and fall within the spirit and scope thereof.

I claim:

1. A competitive character identification board and card game for a plurality of players, comprising:

a game board having a plurality of blocks defining a main path delineated about the periphery of the board and defining a plurality of subsidiary paths leading from the main path to a block in the center of the board;

a plurality of differently identified tokens sufficient in number to provide each player with a token whereby each player's position on the game board may be identified;

a number selection device adapted to determine order of play among the players and the number of blocks to which a player's token is to advance;

a plurality of resumes each of which contains on one side a plurality of biographical entries providing clues to the identity of a particular character and one entry providing the identity of the character whereby one or more of said clues are provided a player whose token lands on a block in the main path and whereby a player's continued advancement about the game board is determined by correctly identifying the character on a resume from clues contained thereon;

a box for holding resumes which box contains on one face a plurality of windows with individual means for covering each window, whereby a window is opened revealing an entry on a resume for each player whose token lands on a block in the main path on the board;

a plurality of chips which are used to obtain additional clues on a resume, some of which chips a player is given at the beginning of the game and others of which a player obtains by guessing the identity of a resume character or by landing on a particular block in the main path on the game board;

a plurality of pins one of which is obtained by a player each time the player guesses the identity of a resume character and which are attached to the token of the player correctly guessing; and a plurality of cards containing a plurality of biographical entries providing clues to the identity of a particular character and one entry providing the identity of the character, whereby a player having a certain number of pins and having gained access to a subsidiary path is given clues from the card and his advancement towards the block in the center of the board determined by the number of clues given before the character is identified by said player.

2. A competitive character identification board and card game as recited in claim 1, wherein:

One of said blocks represents a game start block, and the block in the center of the board represents a game finish block, and other of said blocks are specially designated with appropriate markings thereon.

3. A competitive character identification board and card game as recited in claim 2, wherein:

the resumes inside the box and the windows on the face of the box are so arranged that, when a window is opened, an individual entry on a resume is revealed.

4. A competitive character identification board and card game as recited in claim 3, wherein:

certain of the windows on said box are opened for an individual player only in exchange for a chip.

5. A competitive character identification board and card game as recited in claim 4, wherein:

each resume has twenty entries on a side pertaining to a specific character, the last entry of which contains the character's identity.

6. A competitive character identification board and card game as recited in claim 5, wherein:

the entries on a resume are arranged in two vertical rows of ten entries each.

* * * * *